US006290194B1

(12) United States Patent
Chaconas et al.

(10) Patent No.: US 6,290,194 B1
(45) Date of Patent: Sep. 18, 2001

(54) BLOWER UNIT RETENTION APPARATUS

(75) Inventors: John J. Chaconas, N. Charleston; James R. Stolpmann, Charleston; Jonathan H. Mueller, Mt. Pleasant; Gary W. Ferdon, Charleston; Roger D. Dalton, Moncks Corner, all of SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/233,682

(22) Filed: Jan. 19, 1999

(51) Int. Cl.[7] ..... A47B 96/06; A47G 29/00; A47K 1/00; E04G 3/00; E04G 5/06

(52) U.S. Cl. ..... 248/214; 248/346.11

(58) Field of Search ..... 248/214, 346.11; 5/706, 710, 713, 658

(56) References Cited

U.S. PATENT DOCUMENTS

| | | | | |
|---|---|---|---|---|
| 1,043,370 | | 11/1912 | Stubbs . | |
| 4,190,280 | * | 2/1980 | Donohoe | 5/658 |
| 4,312,352 | | 1/1982 | Meisch et al. . | |
| 4,648,144 | * | 3/1987 | Rose | 248/214 |
| 4,691,397 | * | 9/1987 | Netzer | 248/214 |
| 5,149,036 | * | 9/1992 | Sheehan | 5/658 |
| 5,267,364 | | 12/1993 | Volk . | |
| 5,312,077 | * | 5/1994 | Guitierrez | 248/214 |
| 5,542,136 | | 8/1996 | Tappel . | |
| 5,588,166 | * | 12/1996 | Burnett | 248/214 |
| 5,611,096 | * | 3/1997 | Bartlett et al. | 5/710 |
| 5,657,884 | * | 8/1997 | Zilincar, III | 248/220.41 |
| 5,934,639 | * | 8/1999 | Chiang et al. | 248/346.11 |

FOREIGN PATENT DOCUMENTS

| | | |
|---|---|---|
| 7095 | 10/1913 | (GB) . |
| WO 99/09864 | 3/1999 | (WO) . |

* cited by examiner

*Primary Examiner*—Leslie A. Braun
*Assistant Examiner*—J. DeLuca
(74) *Attorney, Agent, or Firm*—Bose McKinney & Evans LLP

(57) ABSTRACT

A retention apparatus is provided for mounting a blower unit for an air mattress to a bed frame member. The blower unit retention apparatus includes a pair of retention brackets, each including a U-shaped member having a base portion and a pair of outwardly projecting arms defining a slot for receiving the bed frame member. A locator pin is configured for insertion through oppositely disposed openings formed in the projecting arms of each of the retention brackets for securing the bed frame member between the locator pins and the respective base portions. An upstanding post is mounted to each of the two retention brackets for reception in a corresponding opening in the blower unit housing to secure the blower unit housing to the bed frame member.

54 Claims, 3 Drawing Sheets

BLOWER UNIT RETENTION APPARATUS

BACKGROUND AND SUMMARY OF THE INVENTION

The present invention generally relates to a bed having a mattress provided with inflatable air bladders for supporting a patient, and particularly to a blower unit for selectively inflating the air bladders. More particularly, the present invention relates to an apparatus for mounting the blower unit to a bed.

Mattresses that include air bladders to support patients are known in the art. Such mattresses typically include an air pressure system for inflating the air bladders to predetermined pressure levels and for monitoring and maintaining the pressure in the air bladders after inflation. The air pressure system, for example, may include a blower or a compressor, a manifold for selectively distributing air to the air bladders, valving for controlling the distribution of air, tubing for connecting the manifold to the air bladders, a plurality of sensors for monitoring the pressure in the air bladders, means for selectively venting the air bladders, a microprocessor for controlling the operation of the system and a housing for encasing the components of the system.

Typically, the blower unit is either positioned on the floor adjacent to the bed or mounted on a footboard of the bed. A mounting hook secured to the blower housing is typically used for mounting the blower unit to the footboard of the bed.

A problem with such mounting means is that the headboards and footboards of some beds, particularly beds used in long term care facilities, are not strong enough to support the blower units. This is particularly a concern because the blower units are typically heavy.

According to the illustrated embodiment the invention, an apparatus is provided for mounting a blower unit for an air mattress on a bed frame member. The apparatus includes at least one retention bracket. Each retention bracket includes a base and a pair of outwardly projecting arms extending away from the base. The arms are spaced apart to define a slot configured to receive the bed frame member. The apparatus also includes a first connector configured to secure the retention bracket to the bed frame member in a cantilevered manner, and a second connector configured to secure the blower unit to the retention bracket.

In the illustrated embodiment, the arms are each formed to include an opening. The first connector includes a pin configured to be inserted through the openings in the arms so that the bed frame member is captured between the base of the retention bracket and the pin. The illustrated retention bracket arms also include a depending lip portion. The bed frame member is illustratively captured between the lip portions of the projecting arms and the pin.

Also in the illustrated embodiment, the second connector includes an upstanding post coupled to the retention bracket for insertion into an opening formed in the blower unit. Illustratively, first and second spaced apart retention brackets are used to secure the blower unit to the bed frame member. The bottom surface of the blower unit is formed to include first and second spaced apart openings. The upstanding posts coupled to each of the first and second retention brackets are configured for insertion into the first and second openings, respectively, to couple the blower unit to the bed frame member. Illustratively, the blower unit is formed to include two pairs of first and second openings to accommodate variations in spacing between the first and second retention brackets on the frame member. Also illustratively, the second openings in the blower unit are elongated in order to accommodate further variations in the spacing between the first and second retention brackets.

The illustrated embodiment also includes a protective guard coupled to each retention bracket. The protective guard illustratively includes a mounting bracket coupled to the retention bracket, and a roller rotatably coupled to the mounting bracket. The roller includes a rim portion extending beyond an outer wall of the blower unit. The mounting bracket includes a U-shaped member having a base portion coupled to the retention bracket and a pair of legs projecting outwardly from the base portion. The roller is rotatably coupled between the legs of the mounting bracket. Illustratively, the legs of the mounting bracket and the projecting arms of the retention bracket are disposed in planes which are substantially normal to each other.

Also according to an illustrated embodiment the invention, an apparatus is provided for mounting a blower unit for an air mattress on a bed frame. The apparatus includes at least one retention bracket. Each retention bracket includes means for detachably securing the retention bracket to a bed frame member, and means for detachably securing the blower unit to the retention bracket.

In the illustrated embodiment, the means for detachably securing the blower unit housing to the retention bracket includes an upstanding post coupled to the retention bracket for insertion into an opening in the blower unit. Also in the illustrated embodiment, the retention bracket includes a base and a pair of outwardly projecting arms extending away from the base to define a slot to receive the bed frame member, the pair of arms each being formed to include an opening, and the means for releasably securing the retention bracket to the bed frame member includes a pin configured for insertion through the openings in the arms to couple the retention bracket to the bed frame member.

Further according to an illustrated embodiment the invention, an apparatus is provided for mounting a blower unit for an air mattress on a bed frame member. The apparatus includes a U-shaped member having a base and a pair of outwardly projecting arms extending away from the base to define a slot configured to receive the bed frame member. Each of the arms is formed to include an opening therein. The apparatus also includes a pin configured to be inserted through the openings formed in the projecting arms to secure the bed frame member between the base and the pin, and an upstanding post coupled to one of the arms. The post is configured to be inserted into an opening formed in the blower unit.

In the illustrated embodiment, each of the arms is formed to include a depending lip portion. The bed frame member is captured between the lip portions of the arms and the pin. A tether has a first end coupled to the pin and a second end coupled to the U-shaped member.

Also in the illustrated embodiment, the apparatus includes a protective guard coupled to the U-shaped member. Illustratively, the protective guard includes a mounting bracket coupled to the U-shaped member, and a roller rotatably coupled to the mounting bracket.

Additional features and advantages of the present invention will become apparent to those skilled in the art upon a consideration of the following detailed description of an illustrated embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
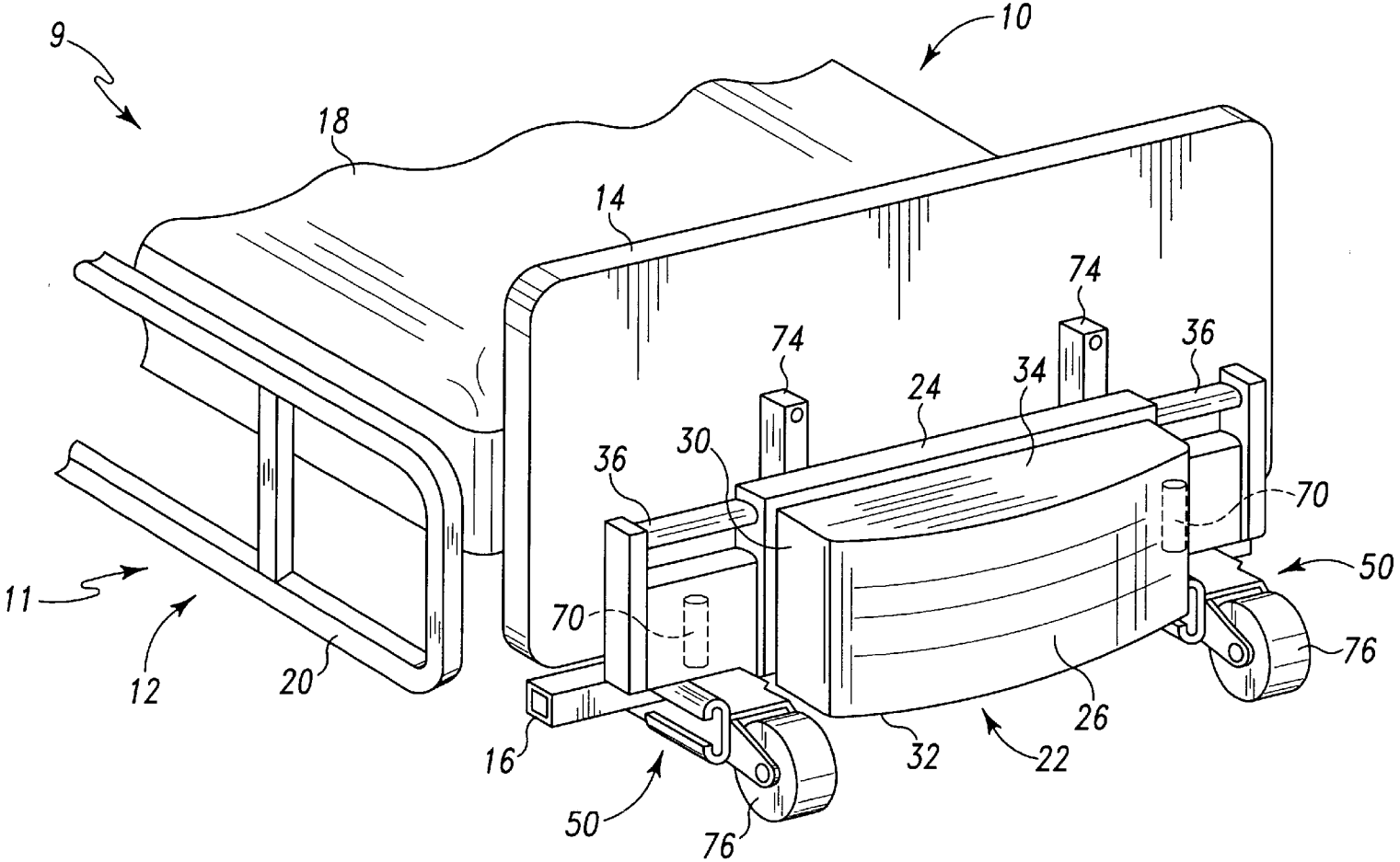
FIG. 1 is a perspective view of a bed including a bed frame and a headboard coupled to the bed frame, and further illustrating a blower unit, and a pair of retention brackets for detachably mounting the blower unit to an end frame member near a head end of the bed.

Referring now to the drawings, FIG. 1 illustrates a bed 10 including an upper portion 9, a lower portion 11, a bed frame 12 having a pair of longitudinally extending side frame members (not shown) and a pair of transversely extending end frame members 16 (only one end frame member shown) connecting the side frame members at the head and foot ends of the bed. A headboard 14 and a footboard (not shown) are coupled to opposite ends of the frame 12. A mattress 18 is supported on the bed frame 12. The mattress 18 illustratively includes a plurality of air bladders to support a patient. Illustratively, mattress 18 is a ZoneAire® mattress available from Hill-Rom, Inc. although other types of mattresses may be used. Siderails 20 may be provided on the bed 10. Siderails 20 are movable between a retracted position, as shown in FIG. 1, and a raised position (not shown) located above the mattress 18.

A blower unit 22 is provided for inflating the air bladders to predetermined pressure levels and for monitoring and maintaining the pressure in the air bladders after inflation. The blower unit 22 is detachably secured to the bed frame 12 by means of a support or two retention brackets 50 in accordance with this invention. As indicated, the blower unit 22 may include but is not limited to, for example, a blower or compressor for producing a supply of air, a manifold for selectively distributing air to the air bladders, valving for controlling the distribution of air, actuators for operating the valves, tubing for connecting the manifold to the air bladders, connectors, a plurality of sensors for monitoring the pressure in the air bladders, means for selectively venting the air bladders to the atmosphere, a microprocessor for controlling the operation of the system, and a housing 24 for encasing the components of the system.

Figure 2:
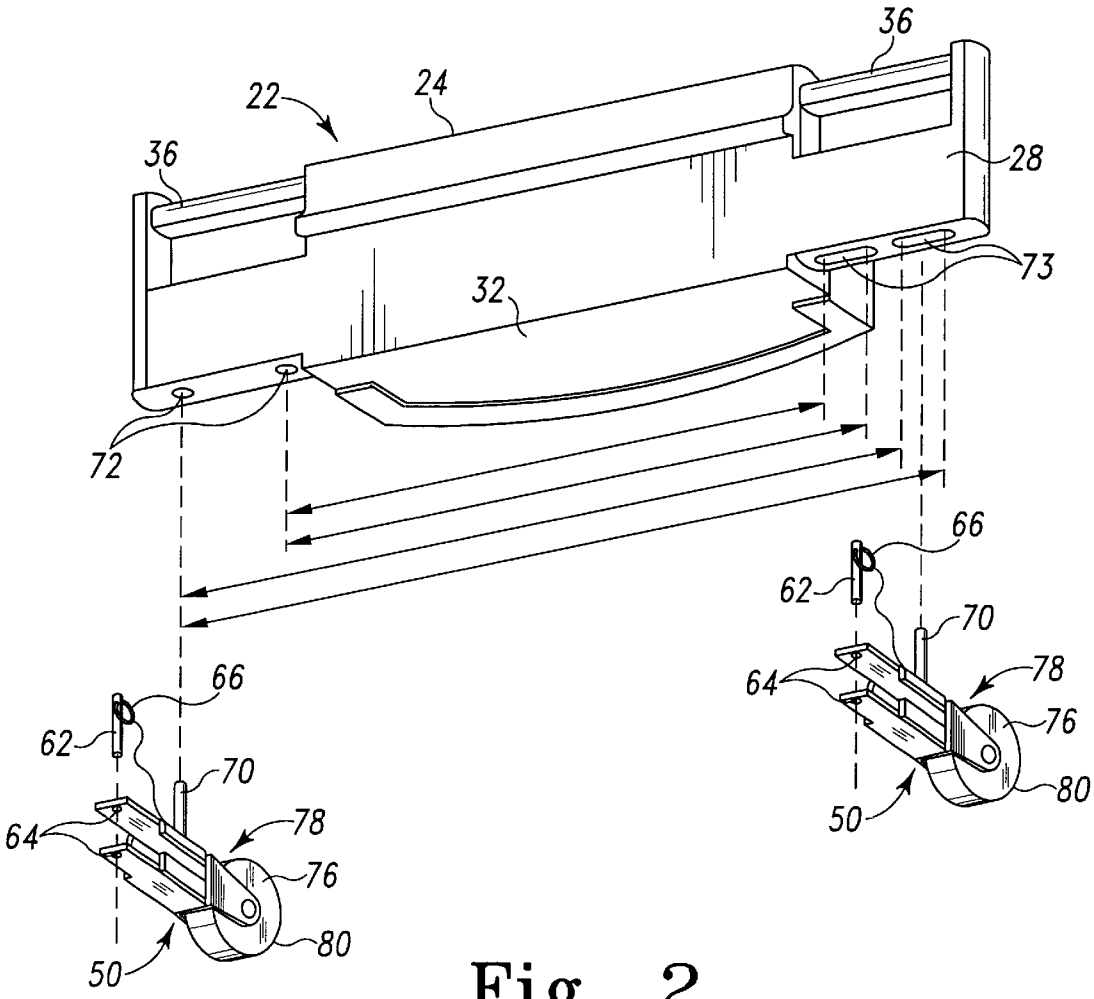
FIG. 2 is an exploded perspective rear view showing the blower unit and the two retention brackets, each of the retention brackets having a rotatably-mounted roller with a protective rim portion extending away from the bed frame and beyond an outer wall of the blower unit housing.

As shown in FIGS. 1 and 2, the blower unit housing 24 includes a front panel 26, a back panel 28, a pair of side panels 30, a coupler or a bottom panel 32 and a top panel 34. The blower unit housing 24 is equipped with a pair of handles 36 to facilitate its installation, removal and transportation. A remote control hand unit (not shown) may be provided for controlling the operation of the blower unit 22.

Figure 3:
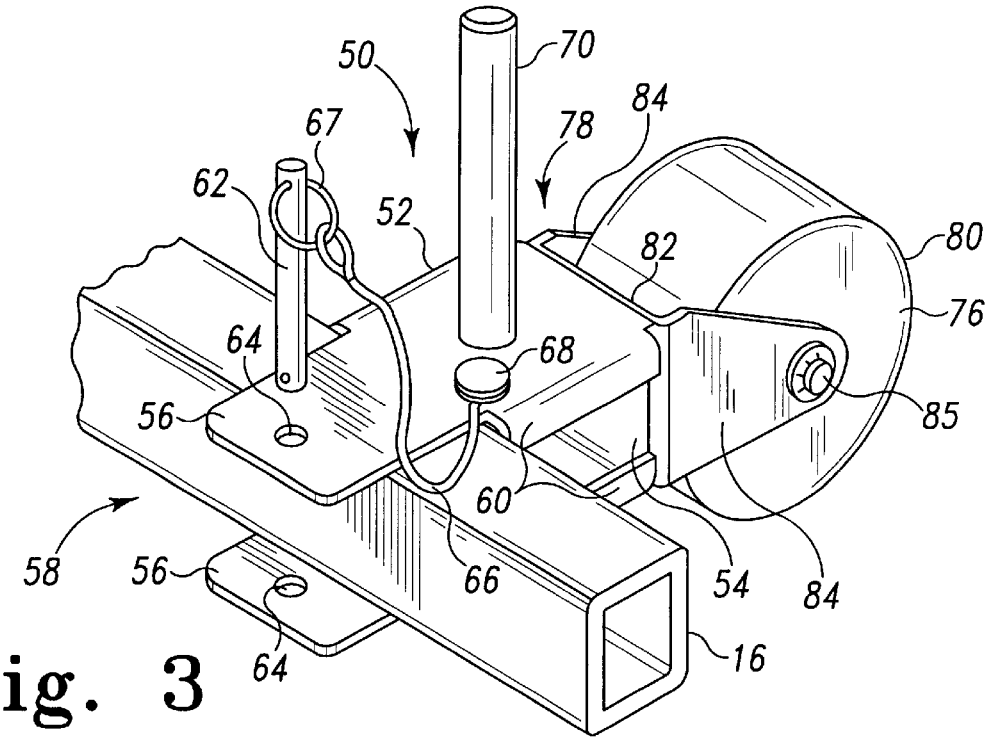
FIG. 3 is an enlarged perspective view of a retention bracket illustrating details of mounting the retention bracket to the end frame member.
Figure 4:
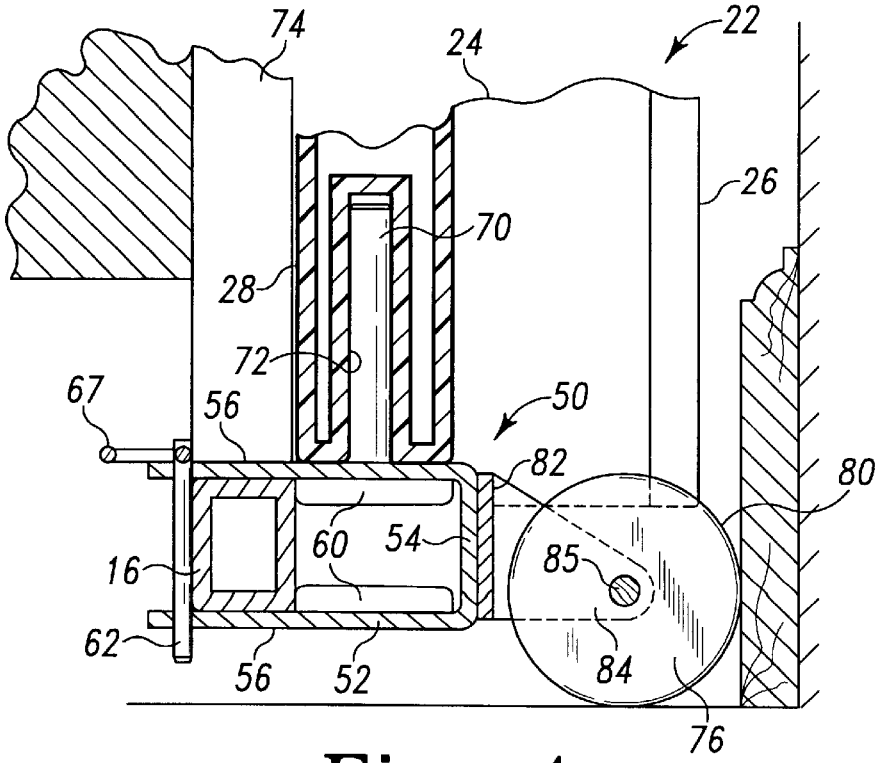
FIG. 4 is a sectional view illustrating details of mounting the blower unit housing to the retention brackets.

As shown in FIGS. 1–4, each of the retention brackets 50 includes a generally U-shaped member 52 having a base portion 54 and a pair of outwardly projecting arms 56 configured to form a slot 58 for receiving a frame member 16 which is illustratively near the head end of the bed 10. Each of the projecting arms 56 is formed to include a depending lip portion 60 on each side thereof The frame member 16 is captured between the depending lip portions 60 and a locator pin 62 which is configured to be inserted through a pair of oppositely disposed openings 64 formed in the projecting arms 56 as shown in FIGS. 3 and 4. A tether 66 has one end secured to the locator pin 62 by a ring 67 and the other end coupled to a fastener 68 which is secured to the retention bracket 50.

An interactive member or upstanding post 70 is mounted to each of the retention brackets 50 and is configured for insertion into a corresponding interactive member or opening 72, 73 formed in the bottom panel 32 of the blower unit housing 24. A first pair of openings 72 are slightly larger than posts 70. A second pair of openings 73 formed in the blower unit housing 24 are elongated in order to accommodate variations in the spacing between the retention brackets 50 on the end frame member 16. Posts 70 extend into only one set of the spaced apart openings 72, 73 to couple the housing 24 to the bed frame 12. Depending upon the configuration of the bed frame, retention brackets 50 may need to be spaced further apart or closer together on the end frame member 16. The operator may use either of the two pairs of openings 72, 73 to couple the blower unit 22 to the frame 12 depending upon the required spacing of brackets 50.

A pair of strut members 74 are illustratively secured to the end frame member 16 near the head end of the bed 10, as shown, for supporting the head board 14. A back panel 28 of the blower unit housing 24 rests against the strut members 74. The blower unit housing 24 is securely held by the upstanding posts 70 when installed.

A roller 76 is rotatably mounted to each of the retention brackets 50 by means of a mounting bracket 78 such that a rim portion 80 of the roller 76 extends away from the retention bracket 50 and the bed frame 12 and beyond the outer wall 26 of the blower unit housing 24, as shown in FIG. 4, to avoid accidental damage to the wall, etc. when the bed 10 is moved. The rim portions 80 of the rollers 76 may be formed from yieldable, resilient material to provide cushion. The mounting bracket 78 includes a base portion 82 and a pair of legs 84 projecting from the base portion. The rollers 76 are rotatably mounted between the legs 84 of the mounting brackets 78 by an axle 85, as shown. The base portions 82 of the mounting brackets 78 are secured to the respective base portions 54 of the retention brackets 50 such that the projecting legs 84 of the mounting brackets are disposed in a plane that is substantially perpendicularly to a plane of the projecting arms 56 of the retention brackets 50.

It is understood that the blower unit 22 may be coupled to other portions of the frame 12, for example, at the foot end or along the sides. Although posts 70 and pins 62 are illustrated for coupling the blower unit 22 to the frame 12, it is understood that other types of connectors or fasteners may be used in accordance with the present invention.

Although this invention has been described in detail with reference to certain illustrated embodiments, variations and modifications exist within the scope and spirit of the invention as described and defined in the following claims.

What is claimed is:

1. An apparatus for use with an air mattress supported by a bed frame comprising a bed frame member, the apparatus comprising:

a blower unit adapted to inflate the air mattress; and at least one retention bracket adapted to support the blower unit, the at least one retention bracket including a base and a pair of outwardly projecting arms extending away from the base, the arms being spaced apart to define a slot configured to receive the bed frame member, a first connector configured to secure the retention bracket to the bed frame member in a cantilevered manner, and a second connector configured to secure the blower unit to the retention bracket.

2. The apparatus of claim 1, wherein the arms are each formed to include an opening, the first connector including a pin configured to be inserted through the openings in the arms so that the bed frame member is captured between the base of the retention bracket and the pin.

3. The apparatus of claim 2, wherein each of the arms includes a depending lip portion, the depending lip portions of the projecting arms and the pin of the first connector adapted to capture the bed frame member therebetween.

4. The apparatus of claim 1, wherein first and second spaced apart retention brackets are used to secure the blower unit to the bed frame member.

5. The apparatus of claim 1, further including a protective guard coupled to each retention bracket.

6. The apparatus of claim 5, wherein the blower unit comprises an outer wall distal from the bed frame member when the blower unit is coupled to the bed frame via the at least one retention bracket, and the protective guard is formed to include a portion extending away from the retention bracket beyond the outer wall of the blower unit.

7. The apparatus of claim 5, wherein the protective guard includes a mounting bracket coupled to the retention bracket, and a roller rotatably coupled to the mounting bracket.

8. The apparatus of claim 7, wherein the roller includes a rim portion extending beyond the outer wall of the blower unit.

9. The apparatus of claim 7, wherein the mounting bracket includes a U-shaped member having a base portion coupled to the retention bracket and a pair of legs projecting outwardly from the base portion, and the roller being rotatably coupled between the legs of the mounting bracket.

10. The apparatus of claim 9, wherein the legs of the mounting bracket and the projecting arms of the retention bracket are disposed in planes which are substantially normal to each other.

11. An apparatus for use with an air mattress supported by a bed frame comprising a bed frame member, the apparatus comprising:

a blower unit adapted to inflate the air mattress; and at least one retention bracket adapted to support the blower unit, the at least one retention bracket including a base and a pair of outwardly projecting arms extending away from the base, the arms being spaced apart to define a slot configured to receive the bed frame member, a first connector configured to secure the retention bracket to the bed frame member, and a second connector configured to secure the blower unit to the retention bracket, wherein the blower unit comprises a opening formed therein, and the second connector includes an upstanding post coupled to the retention bracket for insertion into the opening of the blower unit.

12. An apparatus for use with an air mattress supported by a bed frame comprising a bed frame member, the apparatus comprising:

a blower unit adapted to inflate the air mattress; and at least one retention bracket adapted to support the blower unit, the at least one retention bracket including a base and a pair of outwardly projecting arms extending away from the base, the arms being spaced apart to define a slot configured to receive the bed frame member, a first connector configured to secure the retention bracket to the bed frame member, and a second connector configured to secure the blower unit to the retention bracket, wherein first and second spaced apart retention brackets are used to secure the blower unit to the bed frame member, and wherein the blower unit comprises first and second spaced apart openings, and the second connectors of the first and second retention bracket comprise an upstanding post coupled to each of the first and second retention brackets for insertion into the first and second openings, respectively, to couple the blower unit to the bed frame member.

13. The apparatus of claim 12, wherein the blower unit is formed to include two pairs of first and second openings to accommodate variations in spacing between the first and second retention brackets.

14. The apparatus of claim 12, wherein the second opening in the blower unit is elongated in order to accommodate variations in the spacing between the first and second retention brackets.

15. An apparatus for mounting a blower unit for an air mattress on a bed frame, the apparatus comprising:

at least one retention bracket, each retention bracket including means for detachably securing the retention bracket to a bed frame member in a cantilevered manner, means for detachably securing the blower unit to the retention bracket, and a surface adapted to support the blower unit when the blower unit is detachably secured to the retention bracket.

16. The apparatus of claim 15, further including a protective guard coupled to the retention bracket.

17. The apparatus of claim 16, wherein the protective guard includes a mounting bracket coupled to the retention bracket, and a roller rotatably coupled to the mounting bracket.

18. The apparatus of claim 15, wherein each retention bracket includes a base and a pair of outwardly projecting arms extending away from the base to define a slot to receive the bed frame member, the pair of arms each being formed to include an opening, the means for releasably securing the retention bracket to the bed frame member including a pin configured for insertion through the openings in the arms to couple the retention bracket to the bed frame member.

19. The apparatus of claim 18, further comprising a tether having a first end coupled to the pin and a second end coupled to the retention bracket.

20. The apparatus of claim 18, wherein each of the projecting arms includes a depending lip portion, the depending lip portions of the projecting arms and the pin adapted to capture the bed frame member therebetween.

21. An apparatus for mounting a blower unit for an air mattress on a bed frame, the apparatus comprising:

at least one retention bracket, each retention bracket including means for detachably securing the retention bracket to a bed frame member, and means for detachably securing the blower unit to the retention bracket, wherein the means for detachably securing the blower unit housing to the retention bracket includes an upstanding post coupled to the retention bracket for insertion into the blower unit.

22. An apparatus for mounting a blower unit for an air mattress on a bed frame member, the blower unit having an opening formed therein, the apparatus comprising:

a U-shaped member having a base and a pair of outwardly projecting arms extending away from the base to define a slot configured to receive the bed frame member, each of the arms being formed to include an opening therein, a pin configured to be inserted through the openings formed in the projecting arms to secure the bed frame member between the base and the pin, and an upstanding post coupled to one of the arms, the post being configured to be inserted into the opening formed in the blower unit.

23. The apparatus of claim 22, wherein each of the arms is formed to include a depending lip portion, the depending lip portions of the arms and the pin adapted to capture the bed frame member therebetween.

24. The apparatus of claim 22, further including a protective guard coupled to the U-shaped member.

25. The apparatus of claim 24, wherein the protective guard includes a mounting bracket coupled to the U-shaped member, and a roller rotatably coupled to the mounting bracket.

26. The apparatus of claim 22, further including a tether having a first end coupled to the pin and a second end coupled to the U-shaped member.

27. For use with a bed comprising a mattress and a bed frame supporting the mattress, a blower unit system comprising:

a blower unit adapted to inflate the mattress; and a support adapted to be coupled to the bed frame such that the support extends away from the bed frame, the blower unit being coupled to and positioned on the support, wherein the support comprises a first retention bracket and a second retention bracket spaced apart from the first retention bracket, and each retention bracket comprises a first connector adapted to couple the retention bracket to the bed frame in a cantilevered manner.

28. The blower unit system of claim 27, wherein each retention bracket comprises a second connector adapted to couple the blower unit to the support.

29. The blower unit of claim 27, wherein the blower unit comprises an outer wall distal from the bed frame when the blower unit is coupled to the bed frame via the support, and the support further comprises a roller that extends beyond the outer wall of the blower unit.

30. For use with a bed comprising a mattress and a bed frame supporting the mattress, a blower unit system comprising:

a blower unit adapted to inflate the mattress; and a support adapted to be coupled to the bed frame such that the support extends away from the bed frame, the blower unit being coupled to and positioned on the support, wherein the support comprises a first retention bracket and a second retention bracket spaced apart from the first retention bracket, each retention bracket including a connector, and the blower unit comprises first and second spaced apart openings, and the connectors of the first and second retention bracket comprise an upstanding post coupled to each of the first and second retention brackets for insertion into the first and second openings, respectively, to couple the blower unit to the support.

31. The blower unit of claim 30, wherein the panel blower unit comprises two pairs of first and second openings to accommodate variations in spacing between the first and second retention brackets.

32. The blower unit of claim 30, wherein the second opening in the blower unit is elongated in order to accommodate variations in spacing between the first and second retention brackets.

33. For use with a bed having an upper portion, a lower portion, a mattress and a bed frame supporting the mattress, a blower unit system comprising:

a blower unit adapted to inflate the mattress; and a support adapted to be coupled to the lower portion of the bed such that the support extends away from the lower portion of the bed, the blower unit being coupled to the support, wherein the support comprises a first retention bracket and a second retention bracket spaced apart from the first retention bracket, and each retention bracket comprises a first connector adapted to couple the retention bracket to the lower portion of the bed in a cantilevered manner.

34. The blower unit system of claim 33, wherein each retention bracket comprises a second connector adapted to couple the blower unit to the support.

35. The blower unit system of claim 34, wherein the blower unit comprises first and second spaced apart openings, and the second connectors of the first and second retention bracket comprise an upstanding post coupled to each of the first and second retention brackets for insertion into the first and second openings, respectively, to couple the blower unit to the support.

36. The blower unit of claim 35, wherein the blower unit comprises two pairs of first and second openings to accommodate variations in spacing between the first and second retention brackets.

37. The blower unit of claim 35, wherein the second opening in the blower unit is elongated in order to accommodate variations in spacing between the first and second retention brackets.

38. The blower unit of claim 33, wherein the blower unit comprises an outer wall distal from the lower portion of the bed when the blower unit is coupled to the lower portion of the bed via the support, and the support further comprises a roller that extends beyond the outer wall of the blower unit.

39. For use with a bed having a footprint and comprising a mattress and a bed frame supporting the mattress, a blower unit system comprising:

a blower unit adapted to inflate the mattress; and a support adapted to be coupled to the bed frame such that the support extends beyond the footprint of the bed, the blower unit being coupled to the support, wherein the support comprises a first retention bracket and a second retention bracket spaced apart from the first retention bracket, and each retention bracket comprises a first connector adapted to couple the retention bracket to the bed frame in a cantilevered manner.

40. The blower unit system of claim 39, wherein each retention bracket comprises a second connector adapted to couple the blower unit to the support.

41. The blower unit system of claim 40, wherein the blower unit comprises first and second spaced apart openings, and the second connectors of the first and second retention brackets comprise an upstanding post coupled to each of the first and second retention brackets for insertion into the first and second openings, respectively, to couple the blower unit to the support.

42. The blower unit of claim 41, wherein the blower unit comprises two pairs of first and second openings to accommodate variations in spacing between the first and second retention brackets.

43. The blower unit of claim 41, wherein the second opening in the blower unit is elongated in order to accommodate variations in spacing between the first and second retention brackets.

44. The blower unit of claim 39, wherein the blower unit comprises an outer wall distal from the bed frame when the blower unit is coupled to the bed frame via the support, and the support further comprises a roller that extends beyond the outer wall of the blower unit.

45. For use with a bed having an upper portion, a lower portion, a mattress and a bed frame supporting the mattress, a blower unit system comprising:

a blower unit adapted to inflate the mattress; and a support adapted to be releasably coupled to the lower portion of the bed, the blower unit being coupled to the support, wherein the support comprises a first retention bracket and a second retention bracket spaced apart from the first retention bracket, and each retention bracket comprises a first connector adapted to couple the retention bracket to the lower portion of the bed in a cantilevered manner.

46. The blower unit system of claim 45, wherein each retention bracket comprises a second connector adapted to couple the blower unit to the support.

47. The blower unit system of claim 46, wherein the blower unit comprises first and second spaced apart openings, and the second connectors of the first and second retention bracket comprise an upstanding post coupled to each of the first and second retention brackets for insertion into the first and second openings, respectively, to couple the blower unit to the support.

48. The blower unit of claim 47, wherein the blower unit comprises two pairs of first and second openings to accommodate variations in spacing between the first and second retention brackets.

49. The blower unit of claim 47, wherein the second opening in the blower unit is elongated in order to accommodate variations in spacing between the first and second retention brackets.

50. The blower unit of claim 45, wherein the blower unit comprises an outer wall distal from the lower portion of the bed when the blower unit is coupled to the lower portion of the bed via the support, and the support further comprises a roller that extends beyond the outer wall of the blower unit.

51. For use with a bed comprising a mattress and a bed frame supporting the mattress and a support coupled to the bed frame and comprising at least one interactive member, a blower unit comprising:

a blower adapted to inflate the mattress, and a coupler coupled to the blower and comprising an interactive member that is adapted to interact with the at least one interactive member of the support in order to couple the blower to the support, the interactive member of the coupler adapted to accommodate variations in location of the at least one interactive member of the support.

52. The blower unit of claim 51, wherein the interactive member of the coupler comprise a plurality of spaced apart openings adapted to receive the at least one interactive member of the support.

53. The blower unit of claim 52, wherein the plurality of spaced apart openings comprises at least one elongated opening in order to accommodate variations in spacing between interactive members of the support.

54. The blower unit of claim 51, wherein the interactive member of the coupler comprises two pairs of openings to accommodate variations in spacing between interactive members of the support.

* * * * *